United States Patent [19]

Giles et al.

[11] Patent Number: 4,960,216

[45] Date of Patent: Oct. 2, 1990

[54] PARTIALLY LAMINATED CLOSURE CAP FOR TAMPER PROOF CONTAINER AND METHOD OF MAKING SAME

[75] Inventors: Joseph M. Giles, Lexington; William Bennington, Norman; Steven Brucker, Gibson City, all of Ill.

[73] Assignee: Selig Sealing Products, Inc., Forrest, Ill.

[21] Appl. No.: 394,867

[22] Filed: Aug. 17, 1989

[51] Int. Cl.[5] ..... B65D 51/20

[52] U.S. Cl. ..... 215/232; 220/258

[58] Field of Search ..... 215/232, 305, 347, 348, 215/349; 220/256, 258, 359

[56] References Cited

U.S. PATENT DOCUMENTS

| | | | |
|---|---|---|---|
| 3,317,068 | 5/1967 | Betner | 215/349 X |
| 4,269,321 | 5/1981 | Ichinose et al. | 215/347 X |
| 4,480,760 | 11/1984 | Schonberger | 215/230 |
| 4,576,297 | 3/1986 | Larson | 215/347 X |
| 4,754,890 | 7/1988 | Ullman et al. | 215/232 |
| 4,767,016 | 8/1988 | Cook, Jr. et al. | 215/232 X |
| 4,863,061 | 9/1989 | Moore | 215/232 X |

FOREIGN PATENT DOCUMENTS

| | | | |
|---|---|---|---|
| 284667 | 4/1931 | Italy | 215/305 |
| 8902402 | 3/1989 | PCT Int'l Appl. | 215/347 |

*Primary Examiner*—Stephen Marcus

*Attorney, Agent, or Firm*—Hill, Van Santen, Steadman & Simpson

[57] ABSTRACT

A tamper indicating seal is formed by a first laminate portion, including a layer of aluminum foil and a layer of a heat activated adhesive and a second laminate portion including a layer of heat resistant plastic film or foam and a layer of polyester film. The two laminate portions are secured together by an adhesive layer having two sections: a pattern section and a solid layer section. The solid layer section extends only to about 20% of the diameter of the seal and permanently secures the two laminate sections together. The pattern section covers the remaining portion and only lightly secures the two laminate sections together. The second laminate section can be easily removed from the pattern adhesive to form a pull tab to remove the seal from a container.

11 Claims, 1 Drawing Sheet

FIG. 1
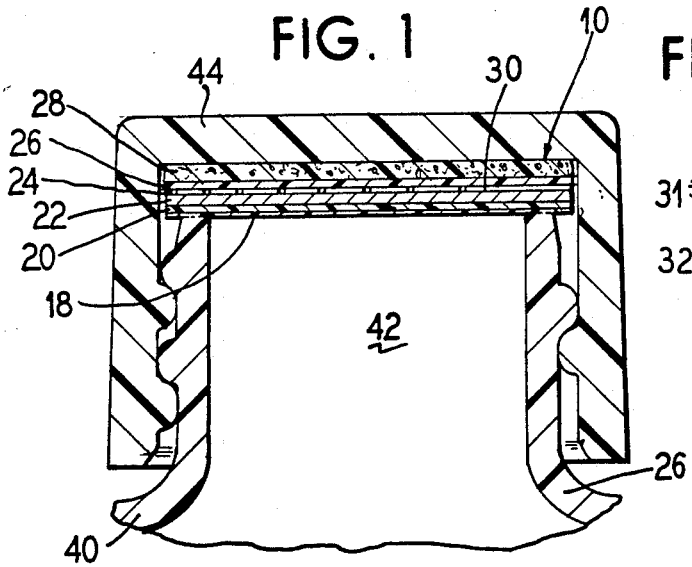
FIG. 2
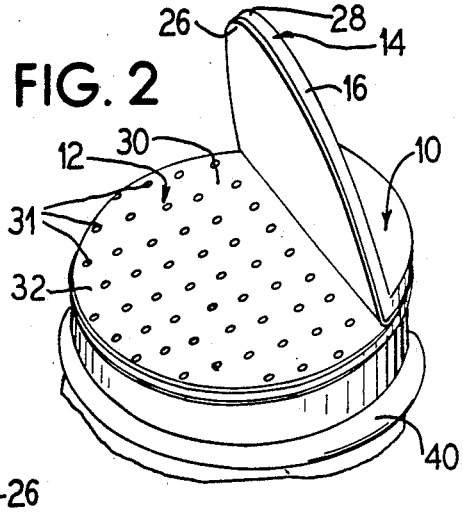
FIG. 4
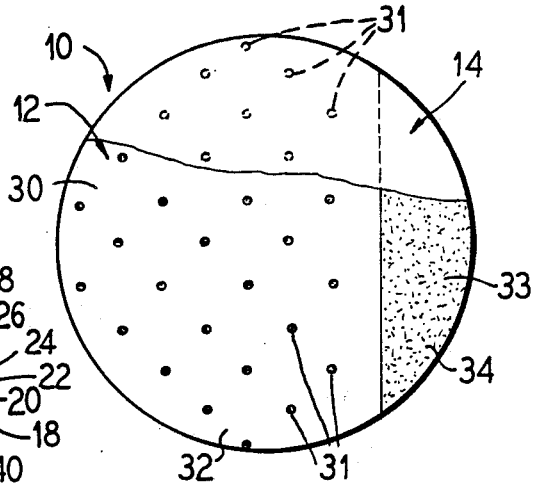
FIG. 3
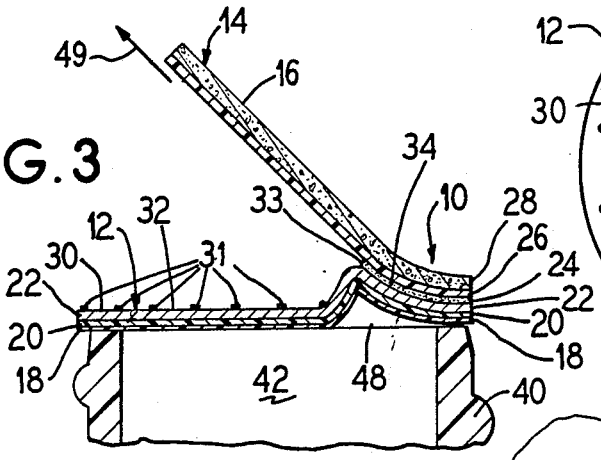
FIG. 5
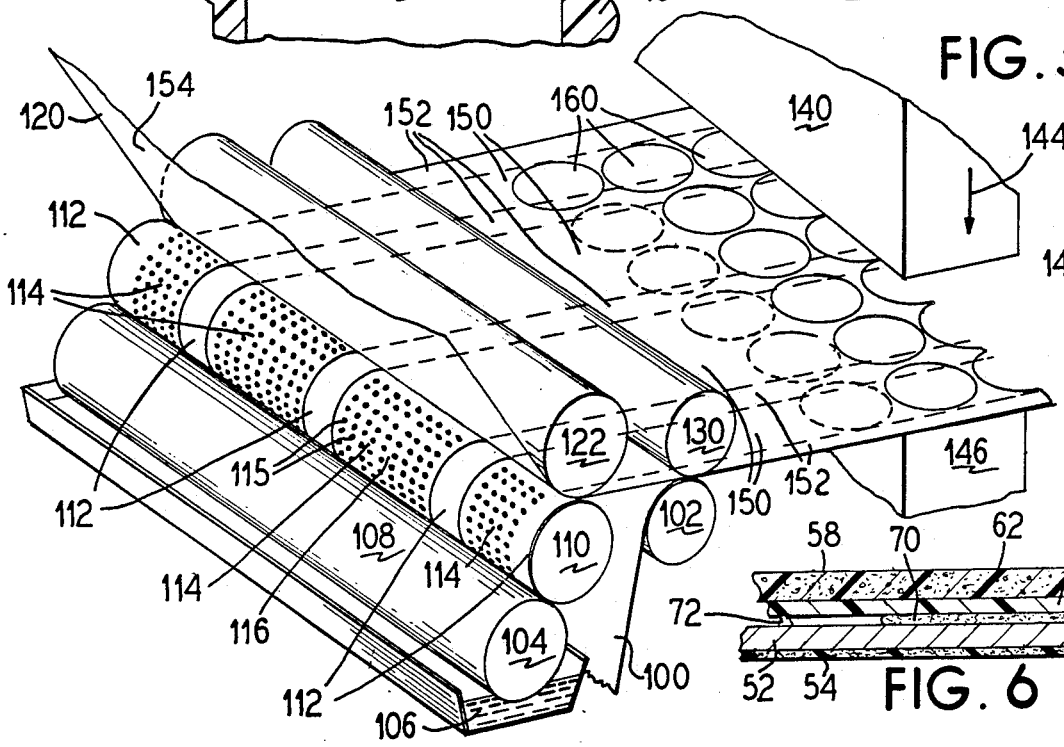
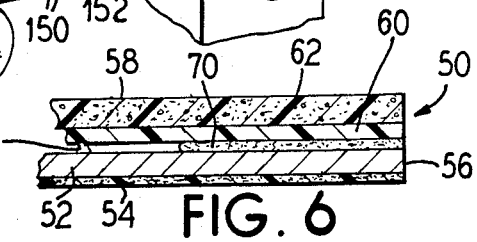
FIG. 6

PARTIALLY LAMINATED CLOSURE CAP FOR TAMPER PROOF CONTAINER AND METHOD OF MAKING SAME

BACKGROUND OF THE INVENTION

The present invention relates generally to tamper proof seals for containers such as bottles and the like and, specifically, to an inner seal having a pull tab formed thereon by affixing an outer laminate to a portion of the top of the seal.

In the packaging of certain products, such as bottled products, it is desirable to provide a seal that retains the freshness of the products and that indicates tampering of the seal. Moreover, it is desirable that such seal be easily removable by the end user of the product.

U.S. Pat. No. 4,501,371 discloses a tamper indicating, non-resealable closure or seal for a container. The closure includes a foil sheet having a layer of thermoplastic material on each surface thereof. The foil sheet is thermally bonded to a container opening. A liner ring overlies the foil sheet and is thermally bonded to the thermoplastic material of the foil.

More recently, another seal is disclosed in an advertisement placed by Stanpac, Inc., a Canadian corporation located in Smithville, Ontario. The Stanpac advertisement, appearing at page 70 of the March, 1988 issue of *Packaging Digest,* discloses a peel-off tamper indicating seal for a container having multiple layers and a tab formed thereon. The seal includes a layer of 0.0015 inches thick aluminum foil with a coating of heat activated adhesive on its bottom surface. Half of a 0.005 inches two-ply sheet formed of polyester laminated two paper is glued to the top surface of the aluminum foil. The seal is shaped like a disc with the unattached half of the polyester-laminated-to-paper sheet forming a pull-tab used to peel off the seal from a container.

The disclosed stampac stamped seal, however, has several drawbacks. The paper layer employed in the tab is susceptible to curling in the presence of moisture. Additionally, because the tab flaps freely, it can become misaligned during capping of a container and then can get in the way of the cap.

SUMMARY OF THE INVENTION

In accordance with principles of the invention, there is provided a seal or an inner seal for a container opening that effectively seals in the product within the container and that indicates tampering with the seal. The seal is easily removable by means of a pull tab attached thereto. The pull tab is especially adapted to provide maximum leverage and to prevent curling thereof due to the effects of humidity. Additionally, a patterned adhesive layer under the tab helps prevent separation of the tab from a foil layer during die cutting and other similar processes, yet allows for easy separation of the tab from the foil layer by a user.

To this end, the invention provides a seal comprising a series of layers including a layer of aluminum foil with a heat activated adhesive on its bottom surface to attach the seal to the opening of a container or jar. Attached to the other side of the aluminum foil is a two-ply sheet of polyester laminated to a thermoplastic foam or film. Less than one-half of the two-ply sheet is glued to the foil layer while the remainder remains free to serve as the pull tab. Until the pull tab is pulled, the inner seal remains firmly affixed to the container via the heat activated adhesive coating. However, the pull tab is lightly secured to the aluminum foil layer to prevent unnecessary flapping during capping or misalignment thereof during die cutting.

BRIEF DESCRIPTION OF THE DRAWINGS

FIG. 1 is a cross-sectional view of a container top including an inner seal formed in accordance with principles of the invention;

FIG. 2 is a perspective view of an inner seal formed in accordance with principles of the invention and affixed to the top of a container;

FIG. 3 is a fragmentary side view of a container including an inner seal formed in accordance with principles of the invention, showing removal of the inner seal;

FIG. 4 is a fragmentary top view of the inner seal of FIG. 2, showing various portions of the inner seal;

FIG. 5 is a perspective view of an apparatus for manufacturing an inner seal in accordance with principles of the invention; and FIG. 6 is a fragmentary cross-sectional view of the inner seal of FIG. 4 taken along the lines VI—VI.

DETAILED DESCRIPTION OF THE PREFERRED EMBODIMENT

In FIGS. 1–4, there is illustrated a seal or an inner seal 10, embodying principles of the invention. The seal 10 includes a seal portion 12 and a tab portion 14. The tab portion 14 is affixed to the seal portion 12 so as to provide a pull tab 16 that can be gripped to remove the seal 10 from an opening 42 of a container 40.

As illustrated, the seal 10 includes six layers: a first heat activated adhesive layer 18; a second film layer 20; a third foil layer 22; a fourth adhesive layer 24; a fifth film layer 26; and a sixth thermoplastic foam or film layer 28. The first heat activated layer 18, the second film layer 20, and the third foil layer 22 are operatively affixed to and associated with each other to form the seal portion 12. The fifth film layer 26 and the sixth thermoplastic foam or film layer 28 are operatively affixed to and associated with each other to form the tab portion 14. The fourth adhesive layer 24 serves to affix the tab portion 14 to the seal portion 12 in a manner to be more fully described below.

In the preferred embodiment, the first heat activated adhesive layer 18 is formed of an ionomer that softens as it is heated to adhere to a surface. Such an ionomer is marketed under the registered trademark Surlyn of E. I. DuPont DeNemours & Company. Such an adhesive can be heated by radio waves and the like to soften and adhere as desired.

The second film layer 20 preferably is formed of a polyester film having a thickness of about 0.005 inches. The polyester film layer 20 keeps the third foil layer 22 from tearing or ripping as an end user removes or peels the seal 10 from the container.

The third foil layer 22 preferably is formed of an aluminum foil having a thickness of about 0.0010 inches. The aluminum foil layer 22 readily indicates tampering because tears therein are irreparable. Moreover, the foil layer 22 is durable and impermeable and thus, effectively seals out moisture and the like from the product contained within the container 40.

The fifth film layer 26 preferably is another layer of polyester film having a thickness of about 0.005 inches. The polyester film layer 26 is relatively durable and provides a strong tab portion 14 which can be gripped by an end user of the product to pull or peel the seal 10 away from and off of the container.

The sixth foam or film layer 28 preferably is made of a hydrophobic and heat resistant film such as polystyrene, resins such as polyphenolene oxide and polystyrene blends, polycarbonates, or polyether imid materials that are thermally resistant to heat dissipated by the third foil layer 22 during the sealing operation. The film or foam layer 28 provides pressure on the ionomer coated seal portion 12 against an uneven top of a container, when capped.

The sixth foam or film layer 28 also prevents curling of the tab member 16 due to the presence of moisture. Because the layer 28 is hydrophobic, the layer 28 will not absorb the moisture and will not curl as would a layer of paper.

Also as illustrated in FIGS. 1–4, the seal 10 is preferably shaped as a disc. Most container openings are circular. Thus, the seal 10 conforms to the shapes of the openings of most containers.

As illustrated most clearly in FIGS. 2 and 4, the tab portion 14 is affixed to the side of the seal portion 12 opposite that of the adhesive layer 18 by the adhesive layer 24. The adhesive layer 24 includes a dot pattern of bumps 31 of applied adhesive bond in a portion 32 on the upper surface 30 of the seal portion 12, and a solid adhesive layer 33 in a portion 34. The solid adhesive layer 33 permanently affixes a portion of the tab portion 14 to the seal portion 12. In contrast, the pattern adhesive bond portion 32 only slightly secures a portion of the tab portion 14 to the seal portion 12. This slightly secured portion is the tab 16. Because of the substantially less bonding on the pattern adhesive bond portion 32, an end user of the product of the container 40 can easily peel away the tab 16 adhered thereto. However, because the tab 16 is secured to the seal portion 12, it does not get in the way of the cap 44 during capping of the container 40. Further, the tab 16 is prevented from separating from the seal portion 12 during a die cutting process or the like, wherein the seal 10 is formed.

The tab 16 is used to pull the seal 10 away from the opening 42 of the container 40 to thus expose product within the container 40. The use of the polyester film layer 26 ensures that the tab 16 is strong enough to withstand the pulling forces exerted by the end user. Moreover, the solid adhesive portion 34 ensures that the tab portion 14 is effectively secured to the seal portion 12 to ensure that the seal 10 is removed from the opening 42 of the container 40.

As illustrated in FIG. 3, when the seal 10 is removed from the opening 42 of the container 40, the tab 16 is peeled from the portion 32 of the seal portion 12 and tugged or pulled until the seal portion 12 begins to peel away from the opening 42. This usually occurs at the point 48 where the solid adhesive layer 33 3nds and the patterned adhesive portion 32 begins. Then the tab 16 is pulled in the direction of the arrow 49 until the seal 10 is removed from the opening 42.

In the preferred embodiment, the solid adhesive portion 34 extends to only about 20% of the diameter of the seal 10. Because the solid adhesive portion 34 extends to only 20% of the diameter of the seal 10, the tab 16 is permitted to exert increased leverage during the removal of the seal 10 from the container 40. Moreover, this allows the seal 10 to achieve a tighter bond to the container 40 and still peel away without tearing.

Illustrated in FIG. 6, is an alternate embodiment of the invention, wherein the second layer of polyester film 20 has been removed. As illustrated, the remaining layers function in the same manner as set forth above.

An inner seal 50 includes an adhesive aluminum foil layer 52 having a heat activated adhesive layer 54 affixed on one side thereof to form a seal portion 56. Attached to a portion of the seal portion 56 is a tab portion 58 including a polyester film layer 60 and a heat resistant film or foam layer 62. The tab portion 58 is attached to the seal portion 56 by means of a solid adhesive layer 70 and an adhesive layer 72 deposited in the form of a pattern of bumps.

The inner seal 50 functions and is removed in a manner similar to that of the seal 10. The main, if not only, difference, is that the aluminum foil layer 52, because of the absence of a polyester film layer attached thereto, might tend to tear more easily as the seal 50 is removed from a container. Thus, although an adequate tamper indicating seal about an opening of a container can be provided by the seal 50, it might be less desirable because the seal 50 can tear more easily.

In FIG. 5, a method of forming the inner seal 10 or 50 is illustrated. A sheet 100 having the layers 18, 20, & 22 or 52 & 54 is carried by a first roller 102. The sheet 100 is produced as is well-known in the art. A second roller 104 rotates such that a portion is submersed within an adhesive bath 106 so that adhesive is picked up on a roller surface 108 thereof. The roller 104 rotates counterclockwise.

A third roller 110 having alternating flat surfaces 112 and patterned surfaces 114 that contact the surface 108 of the roller 104, rotates clockwise so that the surfaces 112 and 114 pick-up the adhesive on the surface 108. The surface 114 is formed so that the ends of projecting members 115 are at the same surface level as the surfaces 112. Thus, the surfaces 114 include a recessed floor 116 from which the projecting members 115 project.

A sheet 120 formed of the layers 26 & 28 or 60 & 62 is carried by a fourth roller 122. The sheet 120 is directed between the roller 110 and the roller 122. This sheet 120 is produced in the known manner.

As illustrated, as the sheet 120 is passed between rollers 122 and 110, the adhesive on the surfaces 112 and 114 is deposited on one side of the sheet 120. It can be appreciated that the surfaces 114 will deposit adhesive on an adhesive laden side 154 of the sheet 120 in the form of a pattern of bumps in an adhesive portion 150 while the surfaces 112 will deposit adhesive in a solid layer on the sheet 120 in a solid adhesive portion 152. The adhesive laden side of the sheet 120 is then pressed against the sheet 100 by the rollers 130 and 102 to secure the two sheets 110 and 120 together. The sheets 100 and 120 are then passed through to a cutting device 140 that cuts or stamps out disc shaped seals 160. The cutting process is such that the diameter of each disc 160 extends beyond a pattern portion 150 by an amount less than or equal to about 20% of the diameter.

It can be appreciated that the pull tab of each seal formed will remain lightly affixed to the corresponding seal portion by means of the adhesive bumps in the pattern adhesive portion 152. During the die cutting step, the pull tab will be secured to the seal portion and will not shift. As a result, a clean die cut is possible.

While a preferred embodiment has been shown, modifications and changes may become apparent to those skilled in the art which shall fall within the spirit and scope of the invention. It is intended that such modifications and changes be covered by the attached claims.

I claim:

1. A tamper indicating inner seal for a container having an opening, comprising:

a first heat-activated adhesive layer for securing said inner seal about said opening;

a second foil layer, one side of which is attached to said first heat-activated adhesive layer;

a third polyester film layer, one side of which is attached to another side of said foil layer;

a fourth heat resistant foam layer, one side of which is attached to another side of said third film layer;

a solid adhesive layer bonding a portion of said third polyester layer to said second foil layer, an area of bonding of which is less than 50% of a total area of said second foil layer; and a pattern adhesive layer slightly bonding a remaining portion of said third polyester film layer to a remaining portion of said second foil layer, said pattern adhesive layer including a plurality of spaced apart adhesive droplets;

whereby to form a liftable tab for manipulation by the fingers of a user to remove the seal from the container and excluding any layer of moisture absorbing material such as kraft paper.

2. An inner seal as set forth in claim 1, wherein said inner seal is in the form of a disc shape and said solid adhesive layer bonding a portion of said third polyester layer to said second foil layer extends from an edge of said inner seal to a distance of about 20% of a diameter of said inner seal or less along said diameter.

3. An inner seal as set forth in claim 1, wherein said second foil layer comprises an aluminum foil layer.

4. An inner seal as set forth in claim 2, wherein said fourth heat resistant foam layer comprises a high temperature thermoplastic foam.

5. An inner seal as set forth in claim 4, wherein said fourth heat resistant foam layer comprises a layer made of any of the groups comprising polyphenolene oxides, polystyrene blends, polycarbonates, and polyether imids.

6. A tamper indicating inner seal for a container having an opening, comprising:

a first heat activated ionomer layer for securing said inner seal about said opening;

a second aluminum foil layer, one side of which is adhered to said first heat activated ionomer layer;

a third polyester film layer, one side of which is attached to another side of said aluminum foil layer;

a fourth heat resistant thermoplastic foam layer, one side of which is attached to another side of said third polyester film layer;

a solid adhesive layer bonding a portion of said third polyester layer to said second aluminum foil layer, an area of bonding which is less than 50% of a total area of said second aluminum foil layer; and a pattern adhesive layer slighting bonding a remaining portion of said third polyester film layer to said second aluminum foil layer, said pattern adhesive layer including a plurality of spaced apart adhesive droplets;

whereby to form a lifting tab separable from said first layer and adapted to remove the seal from the container when lifted and excluding any layer of moisture absorbing material such as kraft paper.

7. A tampering indicating inner seal as set forth in claim 6, wherein said inner seal is in the form of a disc shape and said solid adhesive layer bonding a portion of said third polyester layer to said second foil layer extends from an edge of said inner seal to a distance of about 20% of a diameter of said inner seal or less along said diameter.

8. A tampering indicating inner seal as set forth in claim 6, wherein said second foil layer comprises an aluminum foil layer.

9. A tampering indicating inner seal as set forth in claim 7, wherein said fourth heat resistant foam layer comprises a high temperature thermoplastic foam.

10. A tampering indicating inner seal as set forth in claim 9, wherein said fourth heat resistant foam layer comprises a layer made of any of the groups comprising polyphenolene oxides, polystyrene blends, polycarbonates, and polyether imids.

11. A tamper indicating inner seal for a container having an opening, comprising:

a first heat-activated adhesive layer for securing said inner seal about said opening;

a second polyester film layer, one side of which is attached to said heat-activated adhesive layer;

a third foil layer, one side of which is attached to said second polyester film layer;

a fourth polyester film layer, one side of which is attached to another side of said foil layer;

a fifth heat resistent foam layer, one side of which is attached to another side of said fourth polyester film layer;

a solid adhesive layer bonding a portion of said third foil layer to said fourth polyester film, an area of bonding which is less than 50% of a total area of said third foil layer; and a pattern adhesive lightly bonding a remaining portion of said fourth polyester film layer to a remaining portion of said third foil layer, said pattern adhesive layer including a plurality of spaced apart adhesive droplets so as to form a liftable tab for manipulation by the fingers of a user to remove the seal from the container.

* * * * *